US007119753B2

(12) United States Patent
Hidai et al.

(10) Patent No.: US 7,119,753 B2
(45) Date of Patent: Oct. 10, 2006

(54) SLOT ARRAY ANTENNA

(75) Inventors: Takashi Hidai, Tokyo (JP); Shinobu Tamura, Tokyo (JP)

(73) Assignee: Taiyo Musen Co., Ltd., Tokyo (JP)

( * ) Notice: Subject to any disclaimer, the term of this patent is extended or adjusted under 35 U.S.C. 154(b) by 243 days.

(21) Appl. No.: 10/918,385

(22) Filed: Aug. 16, 2004

(65) Prior Publication Data

US 2005/0040993 A1 Feb. 24, 2005

(30) Foreign Application Priority Data

Aug. 20, 2003 (JP) ..... 2003-332424

(51) Int. Cl.
*H01Q 13/10* (2006.01)
*H01Q 13/00* (2006.01)

(52) U.S. Cl. ..... 343/771; 343/762; 343/770; 343/772; 343/786

(58) Field of Classification Search ..... 343/762, 343/770–772, 786
See application file for complete search history.

(56) References Cited

U.S. PATENT DOCUMENTS 4,546,359 A * 10/1985 Bui-Hai ..... 343/781 R
4,829,312 A * 5/1989 Terakawa et al. ..... 343/756
4,841,308 A * 6/1989 Terakawa et al. ..... 343/771
4,903,037 A * 2/1990 Mitchell et al. ..... 343/756
6,005,528 A * 12/1999 Preiss et al. ..... 343/786

* cited by examiner

*Primary Examiner*—Tan Ho
*Assistant Examiner*—Leith Al-Nazer
(74) *Attorney, Agent, or Firm*—Wenderoth, Lind & Ponack, L.L.P.

(57) ABSTRACT

An object of the invention is to provide a slot array antenna in which unstable factors for contact of an adjustment portion comprising a slot waveguide and a waveguide holder are removed, a number of parts is decreased to save weight, and assembly is simplified. Accordingly, this invention is to constitute a radiation portion (1) unitedly formed of a slot waveguide (1*a*), a flare holder (1*b*), and a supporting portion (1*d*), if necessary, further adding a screen holder (1*c*) for a screen (4) for cross polarization suppression. Furthermore, this invention is to constitute a reinforcement feeder (2) unitedly formed of a feeder waveguide (2*a*), a reinforcement portion (2*b*) and a reinforcement connector (2*c*) in the case of an open type antenna.

22 Claims, 3 Drawing Sheets

SLOT ARRAY ANTENNA

BACKGROUND OF THE INVENTION

This invention relates to a slot array antenna which is used mainly in a radar device.

In a radar device such as a radar for vessels, the slot array antenna comprising a waveguide in which the sharp horizontal surface directivity characteristic is gained relatively easily is employed abundantly.

FIG. 2 shows a sectional view of the so-called open type slot array antenna housing only an antenna unit in a waterproof box (a radome) as one example of a prior slot array antenna.

A slot waveguide (11) shown in FIG. 2 is provided with a plurality of alternately inclined slits (not shown in figures) which constitute an array in an E surface of the waveguide with standard measurement.

A waveguide holder (12*b*) grasps and fixes the slot waveguide (11), and forms an adjustment portion (10) to adjust to a space of a flare (12*a*) and to stabilize a level polarization mode.

A screen (13) for cross polarization suppression is to remove vertical polarization component causing inclination slots which are remained slightly, and is a vertical lattice enough narrow to a wavelength (see FIG. 7). In this embodiment, the screen (13) is formed by bending a metal plate with a plurality of slits and secured on the waveguide holder (12*b*) by screws or rivets. Besides, the screen itself may be omitted, or installed inside a box radiation portion.

In this embodiment, the slot waveguide (11) is held on the above radiation portion by means of the waveguide holder (12*b*) processed by bending a sheet metal, and further constituting the adjustment portion (10) and forming flare (12*a*) to limit directivity in a vertical surface.

Several flare stays (18) are to support an upper portion of the flare (12*a*) mainly, and may be omitted when the flare (12*a*) is strong, for instance, the flare (12*a*) has enough thickness.

Generally, in an open type slot array antenna the full length of which is long and whose horizontal beam width is narrow, an electric power is supplied from one end of the slot waveguide (11), and another end of the slot waveguide (11) is terminated non-reflectively in an adjustment termination (not shown in figures).

Accordingly, a feeder (16) comprising a corner vent, a coaxial waveguide-to-connector adapter or a waveguide flange (not shown in figures) as a feeder opening of a different member is provided, and a feed waveguide (14) connected to the feeder (16) is employed in transmission to an end portion thereof.

FIG. 10 shows one embodiment of the feeder employing the corner vent. In FIG. 10, the feeder (16) is attached on a reinforcement plate (15) and connected to the feed waveguide (14) by welding.

A standard measurement waveguide, which is employed as the feed waveguide (14), is supported by the reinforcement plate (15) from end to end, being connected to the slot waveguide (11) by bending an end portion of it or by using a vent for an end fold (not shown in figures).

The reinforcement plate (15) is arranged over approximately the whole length in a longitudinal direction of the antenna, and secured by screws to the radome (19) and a pedestal (6) for attaching to a scanner main body near a center thereof.

When a part other than a radiation surface (19*a*) of the waterproof box is made of metal, the reinforcement plate (15) may be omitted.

A lower portion of the flare (12*a*) is connected with the reinforcement plate (15) by screws or rivets, and the reinforcement plate (15) is connected with a fastened portion of the slot waveguide holder (12*b*) and the reinforcement plate by screws or rivets respectively to hold a weight in the antenna and to reinforce an inner portion of the box. Besides, in his example, when the radiation surface (19*a*) and the box (19*b*) are formed of resin as a united radome, the radome itself can not be used for reinforcement because of time deterioration by ultraviolet rays, etc., generally. Furthermore, in the case of the so-called dome type small radar which houses a short small antenna and a transmitter-receiver in the waterproof box (not shown in figures), simplification takes precedence because a horizontal beam width is wide, so that a direct feeding from a center in a longitudinal direction of the slot waveguide is carried out.

In this case, there are many things to omit the feed waveguide, the reinforcement plate, the pedestal, etc., generally, to attach a coaxial rotation shaft directly at a center of the waveguide holder (12*b*) or the slot waveguide (11), and to feed after carrying out coaxial waveguide convert inside the center of the slot waveguide are many.

However, in the slot array antenna constituted thus, a gap is created partially in a contact surface (20) between the slot waveguide (11) and the waveguide holder (12*b*), so that the adjustment portion (10) does not function, and as a result, there is a possibility of disorder to the directivity.

Though it is necessary to make a plate thickness of the waveguide holder (12*b*) thicker and to increase fixing points between the screen (13) for removing the cross polarization and the waveguide holder (12*b*) and to press the contact surface (20) evenly, they disturb saving weight and simplifying assembly.

Because some parts relative to the reinforcement can not be reduced any more, new ideas are required for weight saving and simplification.

SUMMARY OF THE INVENTION

The object of the invention is to resolve the above problems, and to provide a slot array antenna in which much reduction of parts, weight saving and simplification of assembly, and stable quality can be gained.

For achieving the above object, the slot array antenna according to the present invention is characterized in that a flare holder (1*b*), a slot waveguide (1*a*) and a supporting portion (1*d*) are constituted unitedly. Furthermore, the invention is characterized in that a screen holder (1*c*) for holding a screen (4) for suppressing cross polarization is united to the flare holder (1*b*).

In the case of an open type antenna, the invention is characterized in that a reinforcement feeder (2) is formed by uniting a feed waveguide (2*a*), a reinforcement portion (2*b*) and a reinforcement connector (2*c*) for supporting a radiation portion, and in that a feed opening is constituted in a feed waveguide portion at a center in a longitudinal direction of the reinforcement feeder (2). Besides, the invention is characterized by constituting an H-shaped vent formed by an inclination piece (7*a*) and a waveguide opening (7*b*), or constituting a coaxial waveguide-to-connector adapter formed by a short-cut piece (9*a*) and a circular hole (9*b*). By being thus constituted, in the slot array antenna according to his invention, it is possible to form the radiation portion (1)

and the reinforcement feeder (2) unitedly by an extrusion, and as a result, the aforementioned problems can be resolved.

It is generally desired in the extrusion that the thickness is even. In the slot array antenna according to the present invention, the extrusion can be easy because the even thickness can be set in the radiation portion (1) and the reinforcement feeder (2) respectively even if many functions are united in them respectively. Besides, instability of contact between the slot waveguide (11) and the waveguide holder (12*b*) as a priority is prevented by uniting the slot waveguide (1*a*) and the flare holder (1*b*). Because of being an abbreviated structure including the screen holder (1*c*), overlaps between materials can be little, a flare (3) and a screen (4) can be formed with thin materials or light materials, and further, they may only insert in the assembly, so that saving weight of the radiation portion and simplification of the assembly can be achieved.

Furthermore, in the case of an open type antenna, because of uniting the reinforcement portion (2*b*), the feed waveguide (2*a*) and the reinforcement connector (2*c*), cooperation of them increases a reinforcement function, so that the materials can be thin and lightened. By uniting the reinforcement portion (2*b*) and the feed waveguide (2*a*), the feeder (16) which was necessary separately before is constituted inside the feed waveguide to contribute to simplification. Furthermore, according to unification and simplification, means for securing such as screws and rivets necessary for assembly and connection and secured portions are decreased largely, so that saving weight of the reinforcement feeder and simplification of the assembly can be achieved.

Thus, according to this invention, an easily assembled slot array antenna is provided in which the number of parts is decreased, the weight is reduced and the quality is stable.

DESCRIPTION OF THE PREFERRED EMBODIMENTS

Hereinafter, the working mode of a slot array antenna according to the present invention is explained by referring the drawings.

Figure 1:
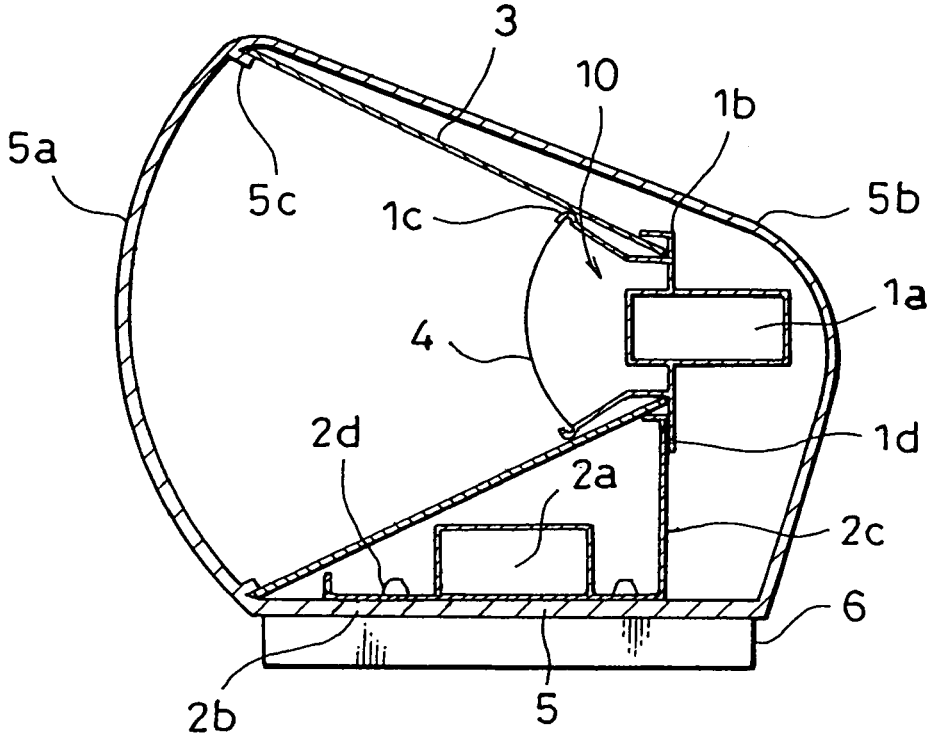
FIG. 1 is a sectional view showing one embodiment of a slot array antenna according to the present invention.

FIG. 1 is a sectional view of one embodiment of the slot array antenna according to the present invention.

In this embodiment a radome radiation portion (5*a*) and a waterproof box portion (5*b*) are formed as a unitary fusion radome made of ABS resin, and little projections (5*c*) as a flare support are provided on a boundary line between the radome radiation portion (5*a*) and the waterproof box portion (5*b*).

Figure 3:
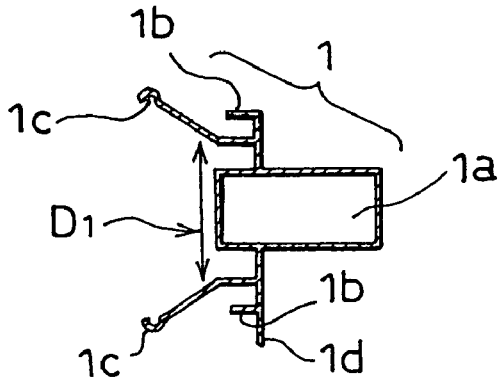
FIG. 3 is a sectional view of a radiation portion.
Figure 4:
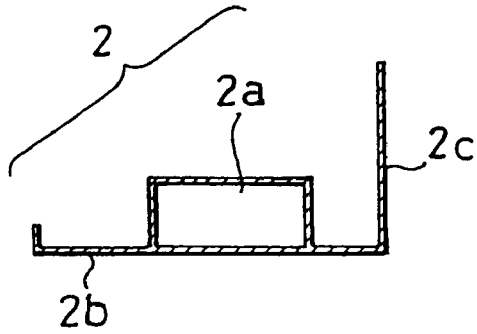
FIG. 4 is a sectional view of a reinforcement feeder.

Furthermore, in this embodiment, a radiation portion (1) is, as shown in FIG. 3, constituted of a slot waveguide (1*a*), a flare holder (1*b*), a holder for a cross polarization removing screen (1*c*) and a supporting portion (1*d*), and formed unitedly (integrally) by an aluminum extrusion, etc.

The slot waveguide (1*a*) is located horizontally and has a plurality of alternately inclined slots (not shown) in an E surface thereof.

The flare (3) comprises a conductor which spreads continuously in the shape of a horn in a vertical cross section thereof.

The flare holder (1*b*) has a constitution such that one end of the flare (3) is inserted, so that one end of the flare consisting of a thin aluminum plate can be secured by only inserting. Accordingly, the flare (3) is supported in the radome (5) by one end of the flare (3) being held by the flare holder (1*b*) and another end of the flare (3) being held by the flare support (5*c*). Since the flare can be formed of a light material such as a thin aluminum plate etc. because it is not for reinforcement, the flare support (5*c*) has only a steadying function, so that it is not necessary to consider a strength of the flare support (5*c*) itself.

Figure 2:
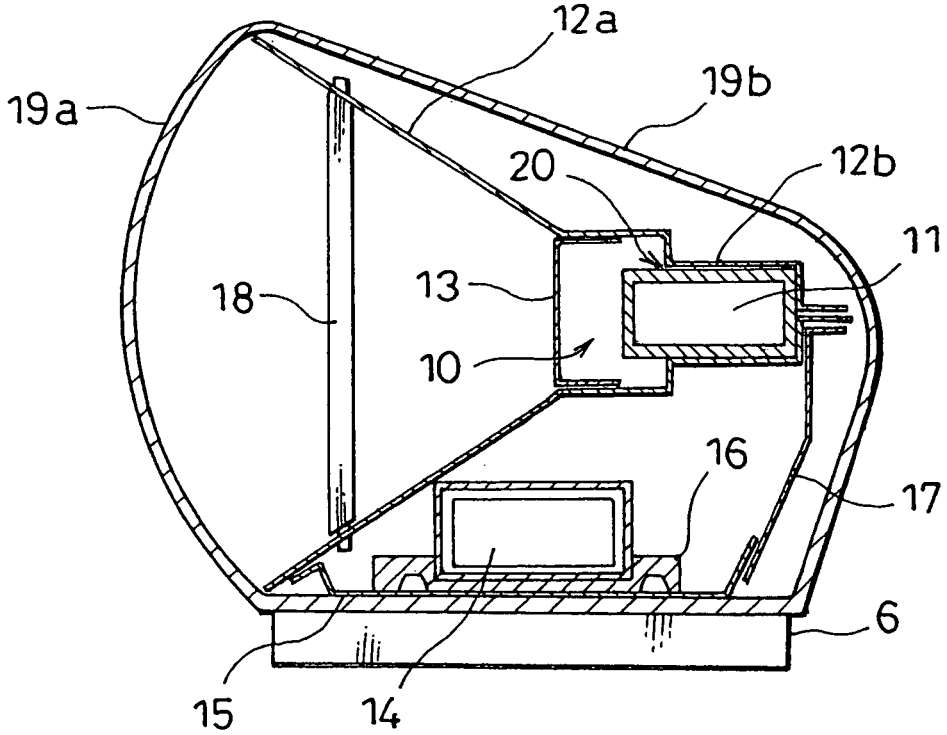
FIG. 2 PRIOR ART
FIG. 2 is a sectional view showing one embodiment of a lot array antenna by a related art.

However, according to an opening angle of a flare material or the flare (3), the flare stay (18) as shown in FIG. 2 may be employed.

Besides, what is formed by applying a conductive coating to a resin plate may be employed as the above-mentioned lightweight material.

Furthermore, in the case of forming the radiation portion (1) by an aluminum extrusion, there is a situation such that a gap of the flare holder (1*b*) can not get smaller or deeper owing to circumstances on the extrusion. In the case that the opening angle of the flare (3), or the gap or the depth necessary to a design form in the adjustment portion (10) is not gained, as shown in FIG. 6, a bent portion (40) is provided in the flare (3) to form an inclination in one end of the flare (3) smaller, or a spacer (8) is provided over a whole circumference of the end of the flare (3) or so as to be inserted partly, so that a necessary holding power can be gained.

Figure 6:
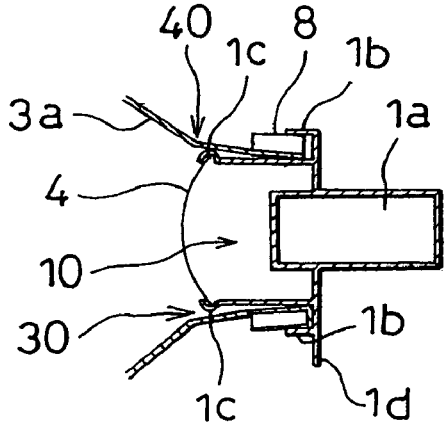
FIG. 6 is an illustration showing one embodiment of a method for securing a flare.

Note that, in the case that a contacting condition in a contact portion (30) as shown in FIG. 6 becomes worse by vibration or shocks etc. if the holding power is weak, or extremely speaking, even if a gap arises in the contact portion (30), characteristics such as directivity are rarely influenced. This is because there is rarely a vertical polarization component since the contact portion (30) is outside the adjustment portion (10), and because gaps more than a half wavelength are necessary for a level polarization component to pass through as a prior art.

As shown in FIG. 1, owing to conveniences in the flare holder (1*b*), though the adjustment portion (10) is not a square cross sectional shape as the prior adjustment portion shown in FIG. 2, it may be better that a vertical dimension D1 as shown in FIG. 3 is set more than a half wavelength of the used frequency, that a level polarization basic mode is passed trough, and that a mode of a high order can be prevented generating as less than one wavelength if possible. Besides, as shown in FIG. 3, the screen holder (1*c*) which holds a screen (4) for cross polarization suppression is united, so that the screen (4) for cross polarization suppression is grasped for securement as shown in FIG. 1.

Figure 7:
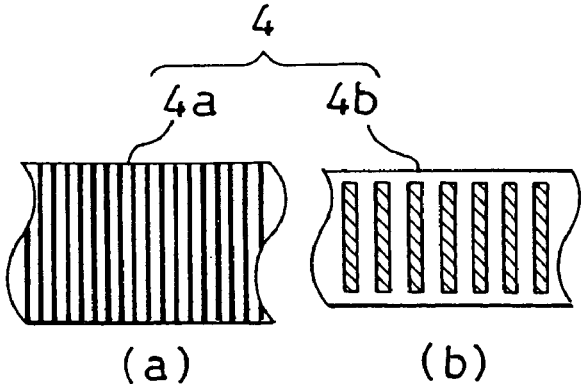
FIG. 7 shows illustrations showing two embodiments for a screen.

Embodiments of the screen (4) are shown in FIG. 7. FIG. 7 (*a*) shows a film screen (4*a*). This film screen (4*a*) is formed by printing conductive coating in a lattice shape to a dielectric plate such as a polyethylene terephthalate film or a polyester film, or forming a lattice by etching on a print circuit substrate. FIG. 7 (*b*) shows an embodiment according to a punching screen (4*b*), in which slits are formed so as to be a lattice shape by, for instance, a punching process to an aluminum plate.

Figure 5:
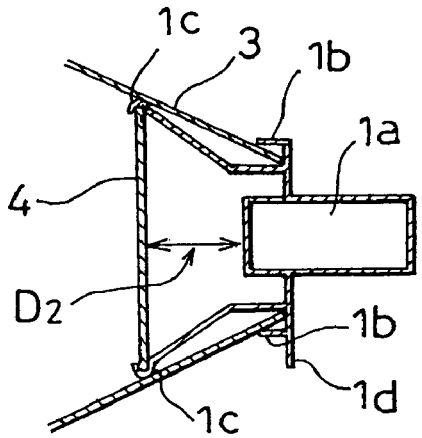
FIG. 5 is an illustration showing one embodiment of a method for securing a screen.

As a method for securing the screen (4), the screen (4) is bent and put as shown in FIG. 1 when it is thin and the screen (4) may be only inserted without bending as shown in FIG. 5 when it is thick comparatively.

Note that, if the vertical length of the screen (4) is over one wavelength of the used frequency, the existence of contact between the lattice and the screen holder hardly influences the cross polarization suppression characteristics etc.

However, because distance (D2) between the slot waveguide and the screen as shown in FIG. 5 influences the cross polarization suppression characteristic or the radiation characteristic of the slot waveguide, it is necessary to give attention to a position of screen holder (1*c*) according to the method for securing. Besides, as a prior art, the cross polarization component, that is a vertical polarization component, is due to the alternately inclined slots which are provided on the slot waveguide (1*a*), there is a case such that screen (4) may not be provided because of decreasing inclination of the slots relatively and decreasing the cross polarization component when a length of an antenna is long relatively and the number of slots are many.

Moreover, the position of the screen (4) is, as shown in the present embodiment, not limited to be in the neighborhood of the slot waveguide (1*a*), for instance, and it may be provided inside the radome radiation portion (5*a*) shown in FIG. 1.

In the case of a dome type small radar in which the transmitter-receiver and the antenna are housed together in the radome (5), as shown in FIGS. 1 and 2, a rotation shaft is attached to the radiation portion (1) also as before, but supported portion (1*d*) may be used for securing.

In the case of an open type antenna which houses the antenna only, reinforcement in the longitudinal direction and feeder cables must be provided. In this case, a reinforcement feeder (2) as shown in FIG. 2 which is formed by the extrusion is employed in this invention.

As shown in FIG. 1, a feeder waveguide (2*a*) is united to a reinforcement portion (2*b*) for securing the feeder waveguide (2*a*) to a bottom of the radome (5) in the reinforcement feeder (2), wherein the feeder waveguide (2*a*) itself has a function as a rib for reinforcement. Furthermore, a reinforcement connector (2*c*) is also united to the reinforcement portion (2*b*) to have a function of a reinforcement rib, so that connection to supporting portion (1*d*) is completed with a few screws or rivets.

Besides, it is desired that connection to the pedestal (6) is secured with self-locking nuts or extrusion screws.

In the case that it is necessary to prevent deviation by vibration when a thin material is employed as the flare (3), a little polystyrene foamed material etc. may be arranged between the upper part of the flare (3) and the radome (5) or the lower part of the flare (3) and the feeder waveguide (2*a*).

Figure 8:
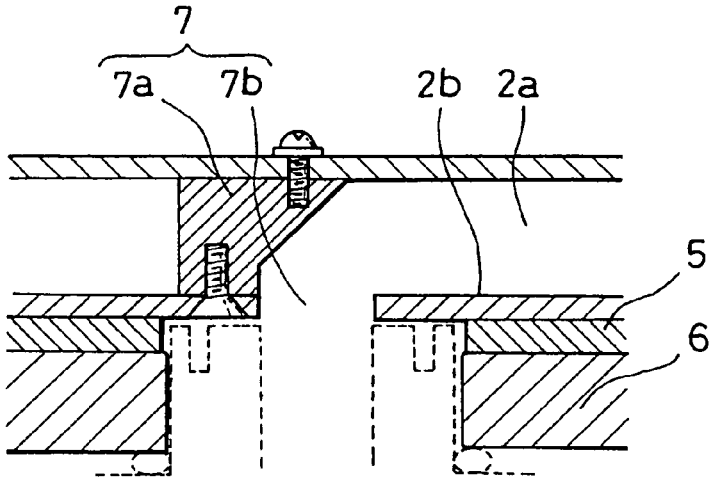
FIG. 8 is an illustration showing one embodiment of a corner vent.
Figure 9:
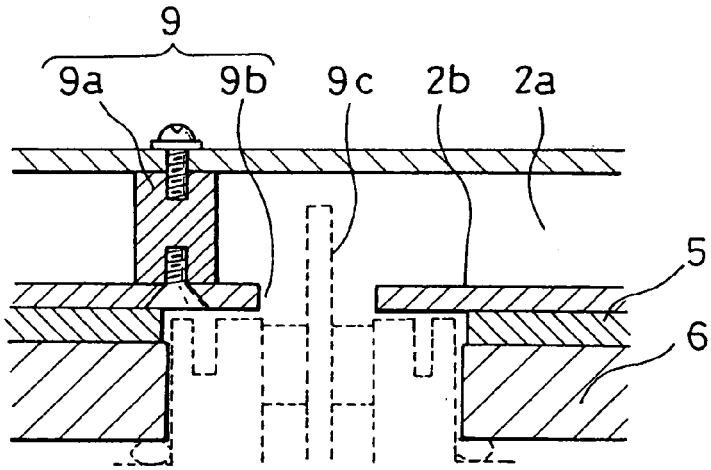
FIG. 9 is an illustration showing one embodiment of a coaxial waveguide to connector adapter.
Figure 10:
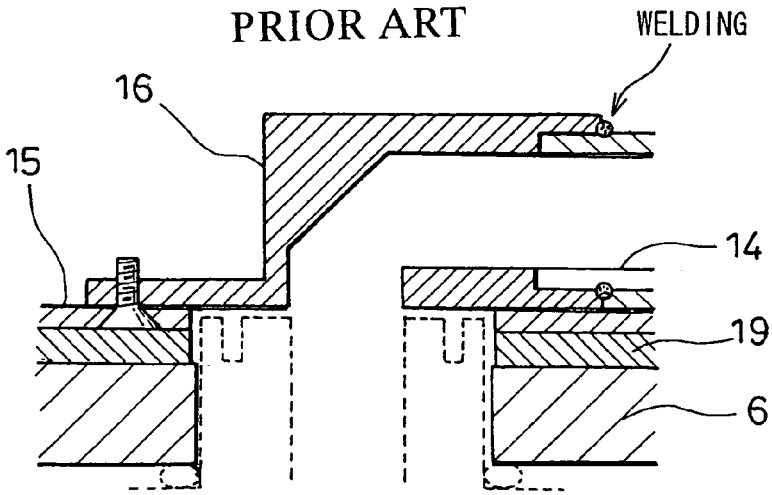
FIG. 10 is an illustration of constitution of a feeder according to the related art.

Furthermore, as a feeder, an H-shaped vent 7 may be constituted of a slant piece (7*a*) and a waveguide opening (7*b*) in the feeder waveguide (2*a*) as shown in FIG. 8, and a coaxial waveguide-to-connector adapter 9 may be constituted of a shortcut piece (9*a*), a circular hole (9*b*) and probe (9*c*) which is inserted into the circular hole (9*b*) as shown in FIG. 9. By being thus constituted, in the slot array antenna according to this invention, the radiation portion (1) and the reinforcement feeder (2) can be formed unitedly (integrally) by the extrusion respectively.

What is claimed is:

1. A slot array antenna comprising at least:

a radome (5);

a flare (3) arranged in said radome (5) and spreading continuously in a horn shape;

a slot waveguide (1*a*) arranged at one end of said flare (3) and having a plurality of slots in an E surface thereof;

a flare holder (1*b*) holding said one end of said flare (3); and a supporting portion for supporting said slot waveguide (1*a*);

wherein a radiation portion (1) is constituted by forming said slot waveguide (1*a*), said flare holder (1*b*) and said supporting portion (1*d*) integrally.

2. A slot array antenna according to claim 1, further comprising a screen (4) for cross polarization suppression, wherein said radiation portion (1) is provided with a screen holder (1*c*) for holding said screen (4) unitedly.

3. A slot array antenna according to claim 2, further comprising:

a feeder waveguide (2*a*);

a reinforcement portion (2*b*) for securing said feeder waveguide (2*a*) to a bottom of said radome (5): and a reinforcement connector (2*c*) for securing said supported portion (1*d*);

wherein a reinforcement feeder (2) is constituted by forming said feeder waveguide (2*a*), said reinforcement portion (2*b*) and said reinforcement connector (2*c*) unitedly.

4. A slot array antenna according to claim 3, wherein:

a feeder is arranged at a center in a longitudinal direction of said feeder waveguide, and said feeder is constituted of an H-shaped vent which comprises a slant piece (7*a*) and a waveguide opening (7*b*).

5. A slot array antenna according to claim 4, further comprising a flare supporter (5*c*) for holding another end of said flare (3) in said radome (5).

6. A slot array antenna according to claim 3, wherein:

a feeder is arranged at a center in a longitudinal direction of said feeder waveguide, and said feeder is constituted of a coaxial waveguide-to-connector adapter which comprises a shortcut piece (9*a*), a circular hole (9*b*) and a probe inserted in said circular hole (9*b*).

7. A slot array antenna according to claim 6, further comprising a flare supporter (5*c*) for holding another end of said flare (3) in said radome (5).

8. A slot array antenna according to claim 3, further comprising a flare supporter (5*c*) for holding another end of said flare (3) in said radome (5).

9. A slot array antenna according to claim 2, further comprising a flare supporter (5*c*) for holding another end of said flare (3) in said radome (5).

10. A slot array antenna according to claim 1, further comprising:

a feeder waveguide (2*a*);

a reinforcement portion (2*b*) for securing said feeder waveguide (2*a*) to a bottom of said radome (5): and a reinforcement connector (2*c*) for securing said supporting portion (1*d*);

wherein a reinforcement feeder (2) is constituted by forming said feeder waveguide (2*a*), said reinforcement portion (2*b*) and said reinforcement connector (2*c*) unitedly.

11. A slot array antenna according to claim 10, wherein:

a feeder is arranged at a center in a longitudinal direction of said feeder waveguide, and said feeder is constituted of an H-shaped vent which comprises a slant piece (7*a*) and a waveguide opening (7*b*).

12. A slot array antenna according to claim 11, further comprising a flare supporter (5*c*) for holding another end of said flare (3) in said radome (5).

13. A slot array antenna according to claim 10, wherein:

a feeder is arranged at a center in a longitudinal direction of said feeder waveguide, and said feeder is constituted of a coaxial waveguide-to-connector adapter which comprises a shortcut piece (9*a*), a circular hole (9*b*) and a probe inserted in said circular hole (9*b*).

14. A slot array antenna according to claim 13, further comprising a flare supporter (5*c*) for holding another end of said flare (3) in said radome (5).

15. A slot array antenna according to claim 10, further comprising a flare supporter (5*c*) for holding another end of said flare (3) in said radome (5).

16. A slot array antenna according to claim 1, further comprising a flare supporter (5*c*) for holding another end of said flare (3) in said radome (5).

17. A slot array antenna comprising at least:

a radome (5);

a flare (3) arranged in said radome (5) and spreading continuously in a horn shape;

a slot waveguide (1*a*) arranged at one end of said flare (3) and having a plurality of slots in an E surface thereof;

a supporting portion for supporting said slot waveguide;

a feeder waveguide (2*a*);

a reinforcement portion (2*b*) for securing said feeder waveguide (2*a*) to a bottom of said radome (5); and a reinforcement connector (2*c*) for securing said supporting portion (1*d*);

wherein a reinforcement feeder (2) is constituted by forming said feeder waveguide (2*a*), said reinforcement portion (2*b*) and said reinforcement connector (2*c*) integrally.

18. A slot array antenna according to claim 17, wherein:

a feeder is arranged at a center in a longitudinal direction of said feeder waveguide, and said feeder is constituted of an H-shaped vent which comprises a slant piece (7*a*) and a waveguide opening (7*b*).

19. A slot array antenna according to claim 18, further comprising a flare supporter (5*c*) for holding another end of said flare (3) in said radome (5).

20. A slot array antenna according to claim 17, wherein:

a feeder is arranged at a center in a longitudinal direction of said feeder waveguide, and said feeder is constituted of a coaxial waveguide-to-connector adapter which comprises a shortcut piece (9*a*), a circular hole (9*b*) and a probe inserted in said circular hole (9*b*).

21. A slot array antenna according to claim 20, further comprising a flare supporter (5*c*) for holding another end of said flare (3) in said radome (5).

22. A slot array antenna according to claim 17, further comprising a flare supporter (5*c*) for holding another end of said flare (3) in said radome (5).

* * * * *